US006526937B1

(12) United States Patent
Bolonkin

(10) Patent No.: US 6,526,937 B1
(45) Date of Patent: Mar. 4, 2003

(54) ECONOMICAL ECCENTRIC INTERNAL COMBUSTION ENGINE

(75) Inventor: Alexander Alexandrovich Bolonkin, Brooklyn, NY (US)

(73) Assignee: Alexander Bolonkin, Brooklyn, NY (US)

( * ) Notice: Subject to any disclaimer, the term of this patent is extended or adjusted under 35 U.S.C. 154(b) by 0 days.

(21) Appl. No.: 09/575,256

(22) Filed: May 22, 2000

(51) Int. Cl.[7] ..... F02B 53/04
(52) U.S. Cl. ..... 123/236; 123/204
(58) Field of Search ..... 123/204, 236; 418/138; 92/92

(56) References Cited

U.S. PATENT DOCUMENTS 1,306,699 A * 6/1919 Johanson ..... 123/236
1,661,593 A * 3/1928 Bodker ..... 123/236
1,757,484 A * 5/1930 Shoemaker ..... 123/236
2,786,332 A * 3/1957 Taverniers ..... 123/204
3,103,920 A * 9/1963 Georges ..... 123/236
3,213,838 A * 10/1965 Douroux ..... 123/236
3,228,196 A * 1/1966 Paulsen ..... 123/236
3,726,259 A * 4/1973 Graves ..... 123/236
3,964,447 A * 6/1976 Normandin ..... 123/236
3,971,346 A * 7/1976 McReynolds ..... 123/236
4,024,840 A * 5/1977 Christy ..... 123/236
5,080,000 A * 1/1992 Bubic ..... 92/92
5,522,356 A * 6/1996 Palmer ..... 123/236

* cited by examiner

*Primary Examiner*—Thomas Denion
*Assistant Examiner*—Tu M. Nguyen

(57) ABSTRACT

An eccentric engine has been used for many different purposes, such as in a piston motor, in a steam engines in a compressor and pump. An eccentric engine include two or more cylinders (stator and rotors) located one within other. The stator has two sections (compression and expansion) and the rotor has slots and blades which are fastened at one end at a rod at a minimum of two symmetrically points about blade center. The blades can reciprocate in slots of rotor. In modification 1 the blade rod has a shape of crankshaft and rotates in opposite direction of rotor; the internal surface of stator is oval or wave formed. In modification 2 the sections of compression and expansion are located along the stator axis, and the rotor is common in both sections. The engine has two combustion chambers. In modification 3 engine has two rotors are separated by partition and connected by rotary blade rod. The rotors can have different diameters and widths.

5 Claims, 8 Drawing Sheets

ECONOMICAL ECCENTRIC INTERNAL COMBUSTION ENGINE

CROSS-REFERENCE TO RELATED APPLICATIONS

Application Ser. 08/892,665 of Jul. 14, 1997 Author A. Bolonkin

REFERENCE TO A MICROFICHE APPENDIX

Not Applicable

BACKGROUND OF THE INVENTION

1. Field of the Invention

The invention presented relates in general to a piston machine and more specifically to an eccentric rotary piston device which may be used for many different purposes, such as: an internal combustion engine; a rotor piston motor, a steam or air engine, a compressor or a pump.

The invention may be used in cars, trucks, motorcycles, ships, airplanes, trains, etc.

2. Description of the Related Art

The existing internal combustion piston and Diesel engines have reached the virtual limitation of their development. Significant or revolutionary improvements in fuel rate, weight, size, specific power, etc., are not possible. The connecting rod-crankshaft mechanism is a major bottleneck.

The crank mechanism of a conventional piston engine doesn't allow high compression ratios (low fuel rate) to make high revolutions per minute (high specific power). Because gas pressure on the full piston surface creates a high mechanical load, the motion of the piston produces a very large inertial load, and a large force at the piston causes a very large friction loss. Special systems of cooling, oil and ignition complicates conventional piston engines. The proposed new eccentric internal combustion engine brings about significant improvement in most of the engine indexes, and especially in its economical aspects.

Similar engines to the proposed engine currently exist. One such engine is the rotor engine of Wankel (See R. f. Andsdale, "The Wankel RC engine", A.S.Barnes&Co., Inc., N.Y., 1969.). The author Richard Stone wrote about the Wankel engine in his book "Introduction to Internal Combustion Engine", Macmillian, 1987, p.17:

"The major disadvantages of the Wankel engine were its low efficiency (caused by limited compression ratio) and the high exhaust emissions resulting from the poor combustion chamber shape".

Another engine similar to the proposed engine is the rotary piston machine of Franz—Joachin Runge (see U.S. Pat. No. 3,572,985 U.S. cl. 418/138). It has two cylinders one of which is located inside the other. The internal cylinder has slots where the blades reciprocate. The ends of the blades are fixed to an axle at a single asymmetrical point. As a result there is a large blade bending moment, which doesn't allow the engine to develop high revolutions and decreases the specific power. The location of compression and expansion chambers inside the rotor makes very difficult, sometimes impossible, the cooling of the engine.

Another engine similar to the proposed engine is the rotor engine of O. W. Johnson (see U.S. Pat. No. 3,215,129). It has a rotary combustion chamber. This combustion chamber can not work because any lubricants will burn in the combustion chamber. This engine has also a suction channel which is offset 90 degree from the point where the rotor and stator touch. This makes a 'dead' space where air-fuel mixture will be compressed to infinity and turns back the rotor. As a result Johnson's engine can not work. This engine has also a rotary blade rod, which dramatically increases friction.

Another engine similar to the proposed engine is the rotor engine of J. C. Bullen (U.S. Pat. No. 2,158,532). This engine has a different design from the suggested engine and has a valve at the entrance and exit of the combustion chamber. The exit valve will burn in the high temperatures which exist in the combustion chamber.

Another engine similar to the proposed engine is the rotor engine Soei Umeda (U.S. Pat. No. 4,422,419), E. M. Douroux (U.S. Pat. No. 3,213,838), E. G. Johanden (U.S. Pat. No. 1,306,699), C. A. Chrisry (U.S. Pat. No. 4,024,840), C. L. Chen (U.S. Pat. No. 5,479,887), W. Crittenden (U.S. Pat. No. 4,638,776). All these engine are different than the suggested engine and have a high fuel rate.

The engines of McReynolds (U.S. Pat. No. 3,971,346 USA) and Traverniers (U.S. Pat. No. 2,786,332 USA) are very different from suggested engine.

The disclosed invention removes these limitations, increases the specific power and revolutions, and decreases the fuel rate, weight, and size. It simplifies the mechanism and makes production cheaper.

These improvements are reached by fixing the blades at two, or more, symmetrical points about the blade center, which eliminates the blade bending moment and increases the engine revolutions and specific power. The blades and blade rings become the same. This simplifies the design and production, and decreases the cost.

Modification (version) 1 of the suggested eccentric engine also differs from Runge's engine and others. The blade rod in modification 1 of the eccentric engine has a form of crankshaft and rotates in opposed direction of rotor. The inside surface of stator is made oval or wavy shape (form) so that the end of blades have permanent contact with the stator inside surface.

The section of compression and the section of expansion are located in direction of rotor rotation.

The proposed engine (modification 2) differs from Runge's engine in the section of compression and expansion which are located in succession along the stator axis. The rotor is common in both sections.

Modification (embodiment) 2, 3 has two combustion chambers. One of both located in the stator and is stationary. In this case combustion is realized at constant pressure, and we can use various kinds of liquid fuels. The other combustion chamber is located at between the rotor and stator such that the combustion may be realized at constant volume. Therefore, the engine can operate using the Otto's (regular) or Diesel's cycle.

Modification 3 is related to the modification 2 except the following: this version has two rotors. The rotors are separated by the stationary partition and connected one with the other by the rotation axle (blade rod). Modifications 2, 3 can also have one combustion chamber.

The sections of compression and expansion in the modification 2–3 can have a different volume and the rotors in version 3 can have a different width and diameter for decreasing of the fuel rate.

There are other distinctions between known patents and the three modification of the eccentric engine as noted in claims of this invention.

BRIEF SUMMARY OF THE INVENTION

An eccentric engine may be used for many different purposes, such as in a piston motor, in a steam (air) engine, in a compressor and in a pump.

An eccentric engine includes two or more cylinders (stator and rotors) located one within in other. The stator has two sections compression and expansion); the rotor(s) has slots and blades which are fastened by one end to a blade rod at a minimum of two symmetrical points about the blade center. The blades can reciprocate in the slots of the rotor. In Modification 1 the blade rod has a form of crankshaft and rotates in opposite direction of rotor. The internal surface of stator is oval or wave formed. In Modification 2 the sections of compression and expansion are located along of stator axis and separated partition; the rotor is common in both sections. The engine has two combustion chambers. In Modification 3 engine has two rotors are separated by partition and connected by rotary blade rod. The rotors can have different diameters and widths.

DETAILED DESCRIPTION OF THE INVENTION

Figure 1B:
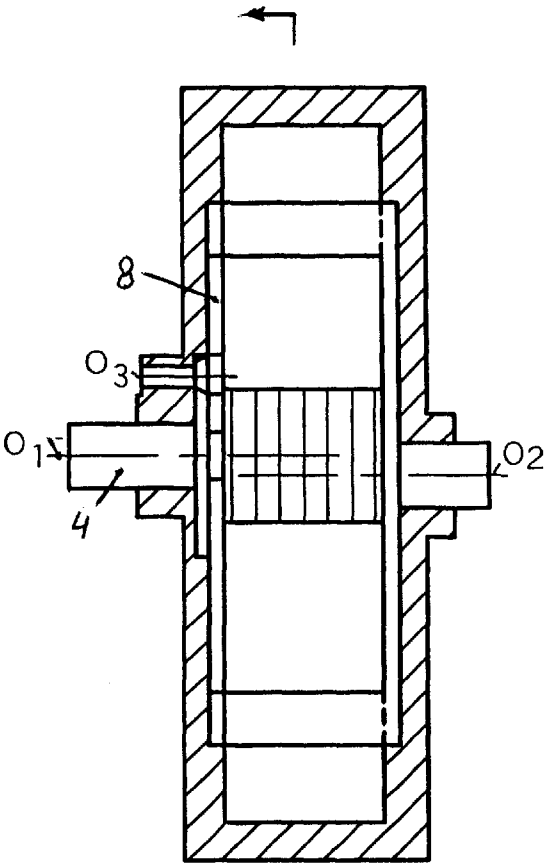
FIG. 1. Eccentric combustion engine with compression and expansion sections located along a rotor rotation (modification 1). 1—stator (body), 2—rotor, 3—blades, 4—revolving crank rod to which the blades are fastened, 5—sealing slots, 6—insert pieces, 7—exit shaft, 8—gear transmission, 9—fuel injector, 16—groove, 18—cooling holes, A—section of suction, B—section of compression, P—section of combustion, C—section of expansion, F—section of exhaust, E—suction nozzle (pipe), G—nozzle (pipe) for exhaust gases.
Figure 1A:
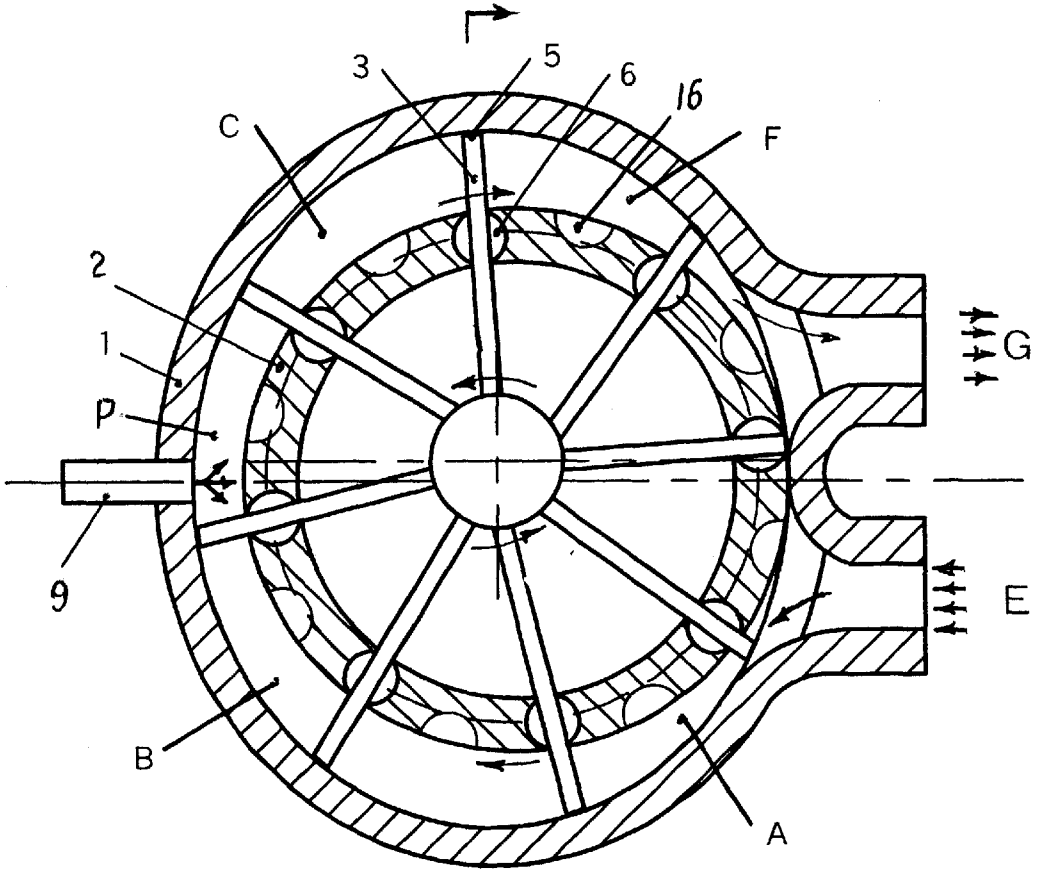

FIG. 1 shows a cross-cut of the first version in the two projections without technological joints.

The engine has the housing 1 (stator, body), an off-center rotor 2, and blades 3 which are fastened at one end to the revolving crank rod 4, (axis $O_1$). The blades contain spring controlled sealed planks 5 and are restricted due to insert pieces 6. The rotor has an exit shaft 7. One has the slots for blades 3 and can revolve on axis $O_2$.

The blade rod 4 has the crankshaft shape and rotates in direction opposite to rotation of rotor by gear transmission 8. when its speed equals to the rotor speed we get one pair of chamber (compression and expansion). If rotation speed of blade rotor 4 becomes two time more than the rotor speed, we will get two pair of the compression and expansion chambers. The engine has two nozzles (pipes): E—suction nozzle, G—nozzle for exhaust gases.

The side projection in FIG. 1 shows the engine's five sections: A—section of suction, B—section of compression, P section of combustion with fuel injection 9, C—section of expansion, F—section of exhaust. The rotor gas grooves 16 used as a combustion. chamber. The stator and rotor have the cooling holes 18 for cooling of internal parts of rotor, stator and blades.

Figure 2A:
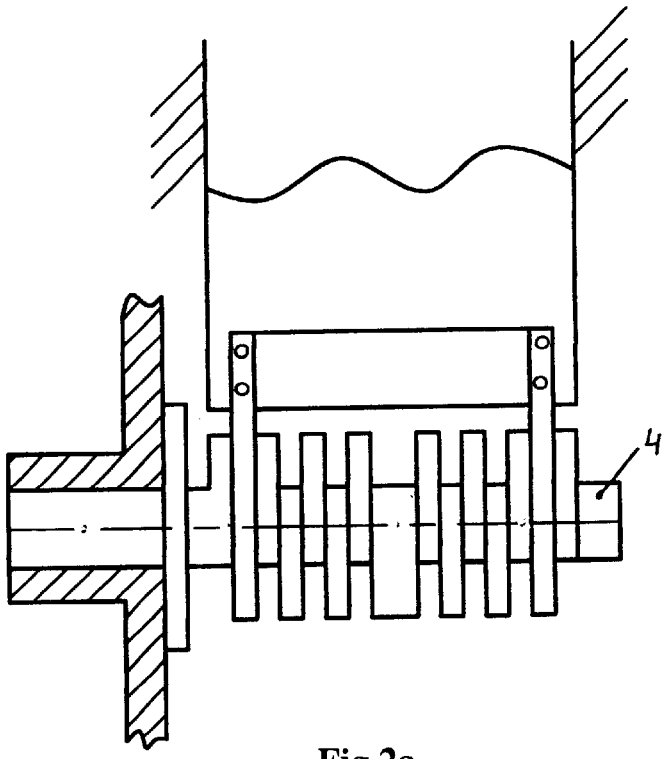
FIG. 2. Diagram of blade lugs for modification 1. This modification can also have the blades connection with lugs is shown in FIG. 7. 3—blade, 32—lugs on the rings, 30—ring.
Figure 2B:
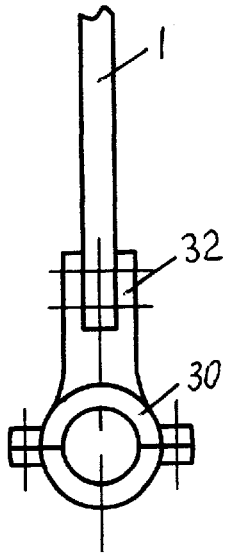
Figure 3A:
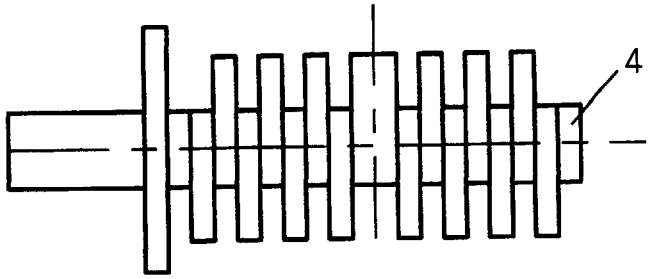
FIG. 3. Crank rod for engine version 1. Blades are fastened to crank rod 4.
Figure 3B:
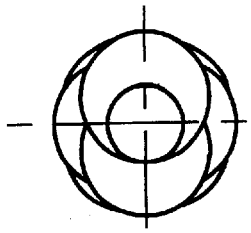
Figure 4:
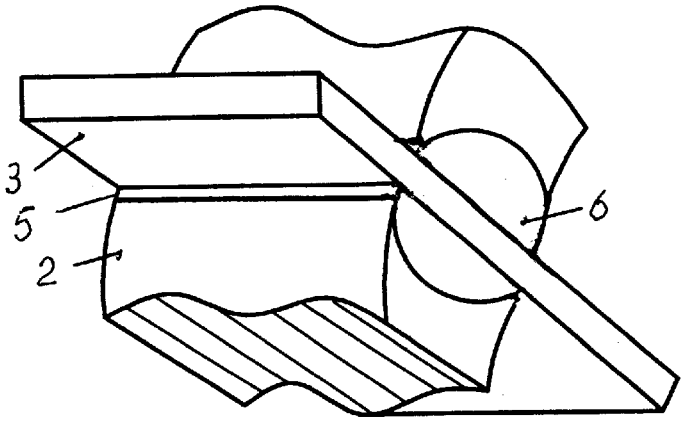
FIG. 4. Diagram of the insert pieces. 2—rotor, 3—blade, 5—sealing slats, 6—insert pieces.
Figure 7A:
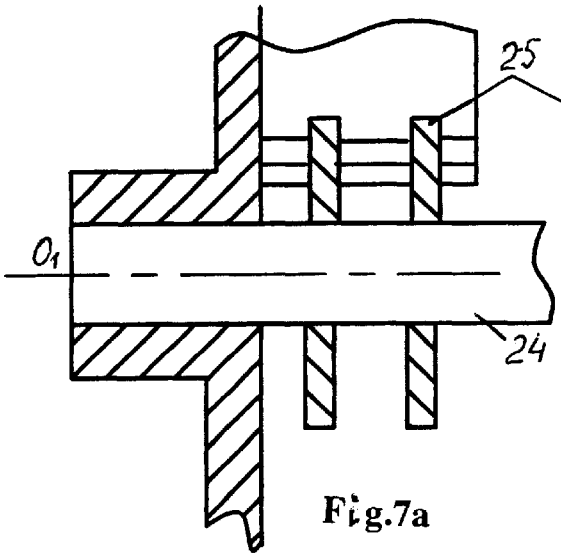
FIG. 7. Diagram of blade lugs. The blade connected at two symmetrical (about the blade center) points. 24—blade rod, 25—ring, 26—lugs on the rings, 3—blades fasten to the lugs in typical "herring bone" fashion.
Figure 7B:
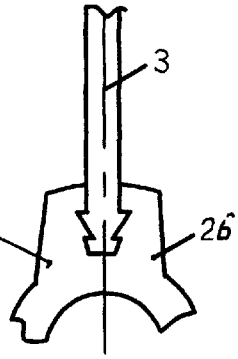

The blade fixing is shown in FIG. 2. It is made from rings 30 with lugs 32. The blade can also be fixed as shown in FIG. 7.

The engine (modification 1, FIG. 1) operates as follows: air is suctioned by blades 3 throw the pipe E into section A, and then compressed in section B. The fuel is injected by fuel injector 9 in section P and is burned out (it realizes cycle near Otto's or Diesel's cycles). The hot gas expanses in section C, where it presses on the blades 3, and revolves the rotor 2, and after expanding in section F, exits through pipe G.

There are several distinguishing characteristics of such an engine. First, the engine is extremely simple. It is composed of a stator and rotor. The rotor has a small number of the same components: blades, fastening rings, blade crank rod and insert pieces. This engine has no power crankshaft or connecting rod mechanism and has only one turning part, the rotor.

Because the blades are fastened on one end to the axle (blade rod) 4 at a minimum of two symmetrical points about the center of the blade (FIG. 2, 7) (except may be the central blade), they do not press on the stator by centrifugal force, and consequently have only a small amount of friction in the engine. This feature enables the engine to be virtually free of the complex system of lubrication for cylinders, and by having a ceramic heat—insulating cover on the inside stator surfaces and outside rotor surfaces, the need for a cooling system is eliminated. Several holes 18 in the stator and a variable inner volume of the rotor circulate enough air to cool the blades and rotor (it is same the for modifications 2, 3).

Figure 5B:
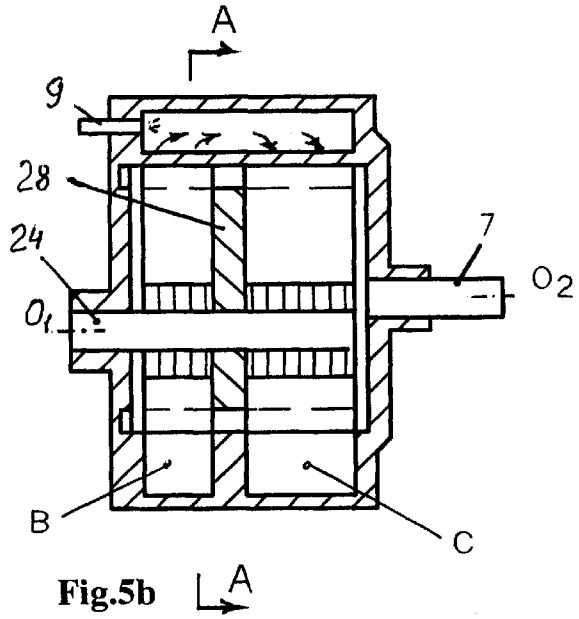
FIG. 5. Eccentric combustion engine in modification 2 with compression and expansion sections located along stator axis. 21—stator (body, 2—rotor, 3—blades, 24—blade rod to which the blades are fastened, 5—sealing slots, 6—insert pieces, 7—exit shaft, 28—sliding immovable partition, 9—fuel injector for combustion in constant pressure, 10—inlet window, 11—outlet window, 12—fuel injector for combustion in constant volume, 13—combustion chamber for combustion in constant pressure and by-pass channel, 16—groove (the second combustion chamber for combustion in constant volume), 17—heating spiral (glow plug), 18—cooling holes on oil cooling, B—section of compression, C—section of expansion, E—suction nozzle (pipe), G—nozzle (pipe) for exhaust gases.
Figure 5A:
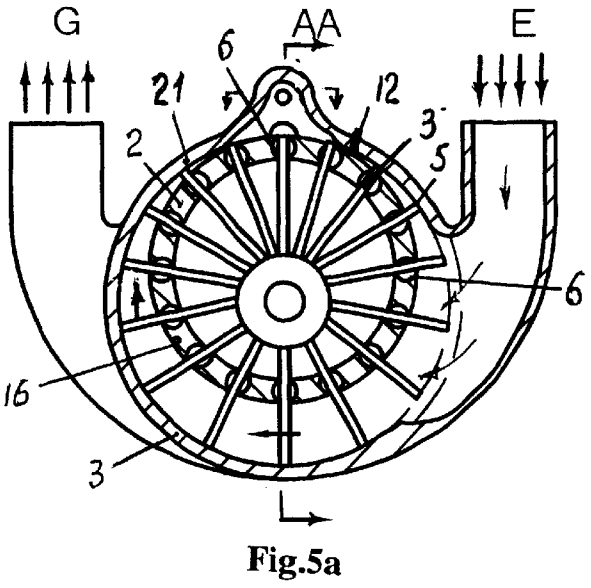
Figure 5C:
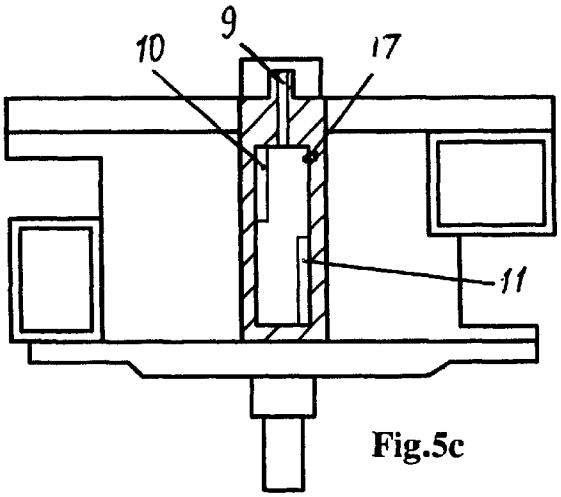

Modification 2 (FIG. 5) differs from the modification 1 in than the blade rod (axle) 24 has a prime cylindrical form, doesn't revolve, and is stationary and rigidly connected with the stator. In this version, the combustion chamber may be stationary, the combustion is realized at constant pressure, the rotor is one piece or unit, and the sections of compression and expansion are parallel to the stator, located along the stator axis and separated by stationary partition.

In modification 2 the fuel system does not need a complicated starting system. The initial ignition at the fuel mixture when starting the engine can be provided, for example, by a battery and a heating spiral 17 (a glow plug). In addition, the engine has a very simple fuel and regulating system since the fuel is injected continuously. However if we turn off the fuel injection 9 and turn on the fuel injection 12 we get combustion in constant volume. This gives more fuel efficiency but limits the variety of the fuels used. This engine may operate using also the Diesel's cycle.

Figure 6:
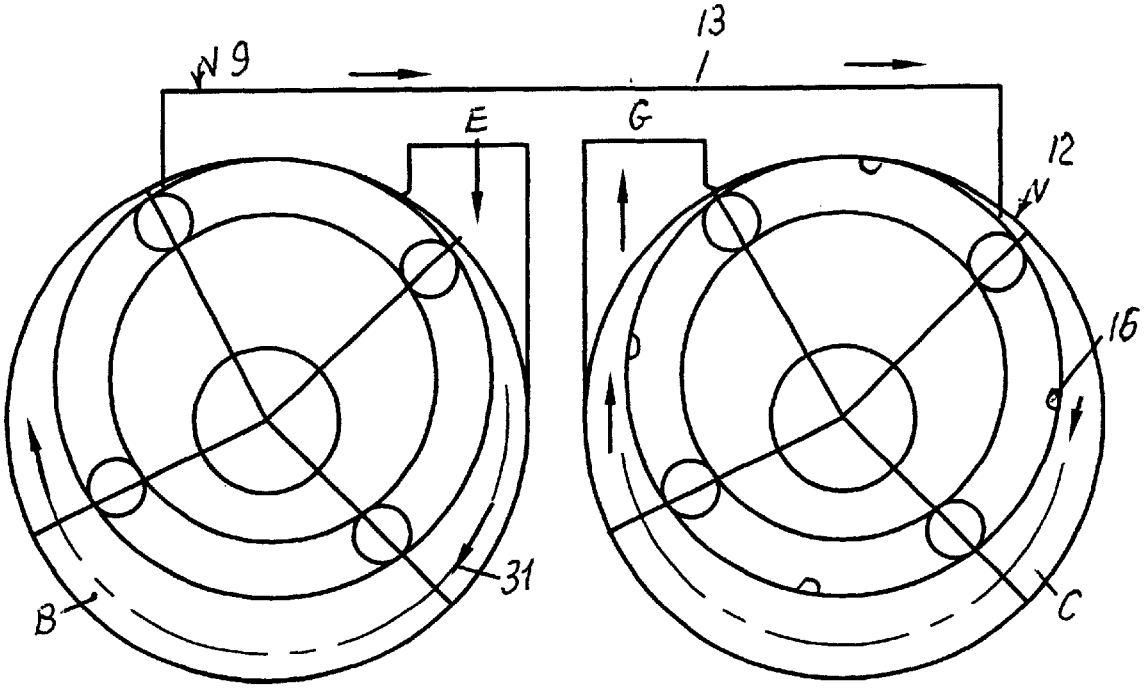
FIG. 6 Schematic view, showing the movement of the gas in the eccentric engine in modifications 2, 3. 31—way of the gas in the eccentric engine, B—compression section, C—expansion section, 13—by-pass channel and combustion chamber; 9, 12—fuel injectors; 16—groove.

The FIG. 6 shows the movement of the gas in modifications 2 and 3. The gas is sucked in section B, and then compressed and passed to section C by channel 13. The fuel may be injected by injector 9 in by-pass channel 13 to set combustion in constant pressure or fuel may be injected in volume between blades by injector 12. In the latter case we have a combustion in constant volume. It is possible that the fuel injectors 9, 12, using difference fuel, can work synchronously. It is impossible for any existing modern engines.

FIG. 7 shows one of schemes for fixing a blade on blade axle (rod). The blades 3 is fasten to the lugs 25 in typical "herring bone" fashion.

Figure 8B:
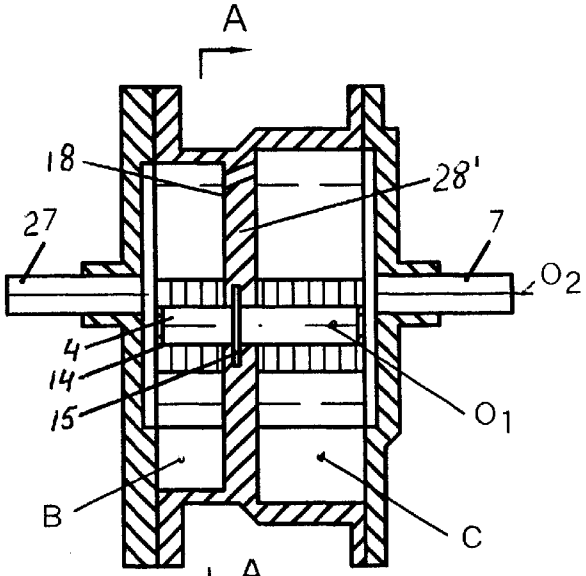
FIG. 8. Eccentric internal combustion engine in modification 3. 1—stator (body), 2—rotor, 3—blades, 27—blade rod to which the blades are fastened, 5—sealing slots, 6—insert pieces, 7—exit shaft, 28—immovable partition, 9—fuel injector, 10—inlet window, 11—outlet window, 12—fuel injector, 13—by-pass channel, 14—splines, 15—flange of rod, 16—circular groove, 18—cooling holes, or oil cooling, B—compression section, C—expansion section, E—suction nozzle (pipe), G—nozzle (pipe) for exhaust gases.
Figure 8A:
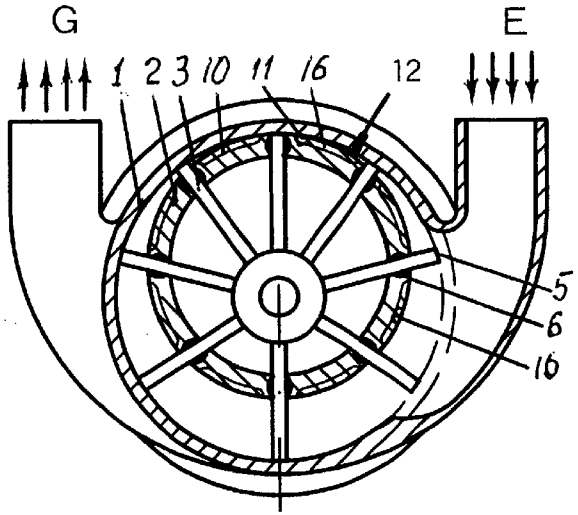
Figure 8C:
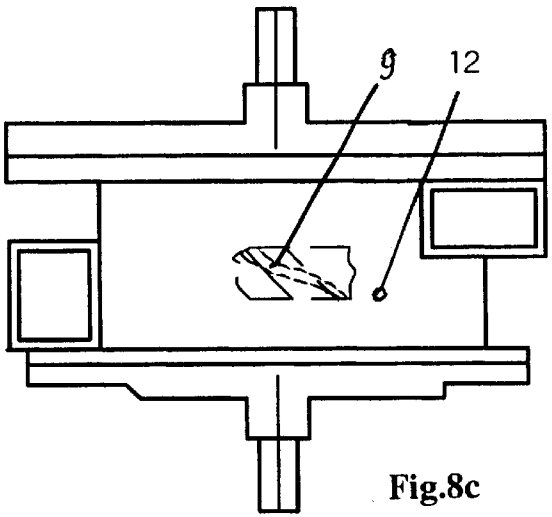
Figure 9:
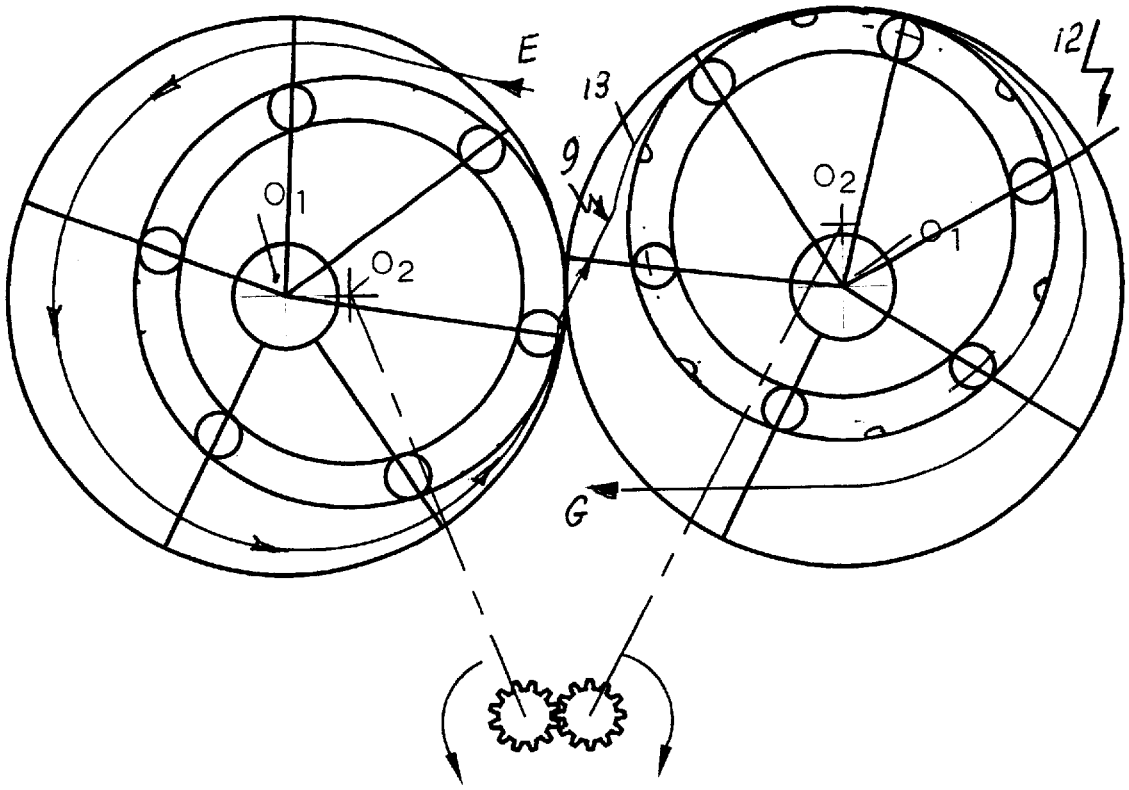
FIG. 9. Scheme of the gas movement out connection rotors for modification 3. Notes are same with FIG. 8.
Figure 10:
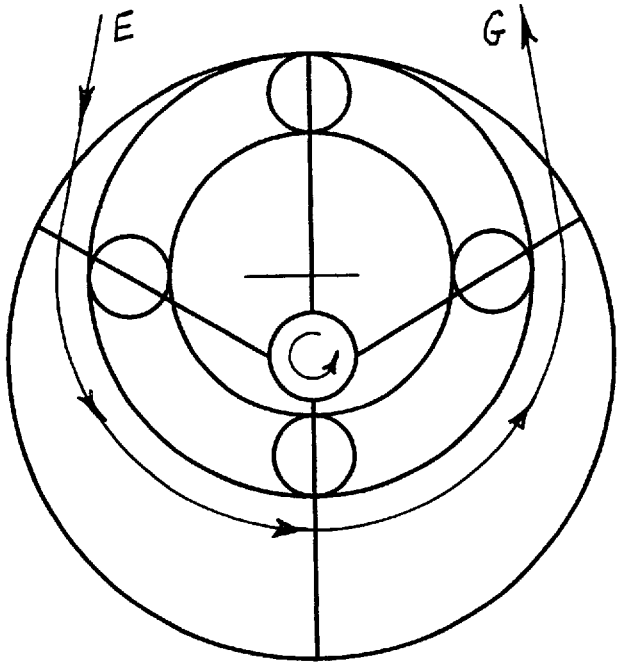
FIG. 10. An illustration of the eccentric engine as a motor used a compression gas (air, steam) or as a pump or compressor.
Figure 11:
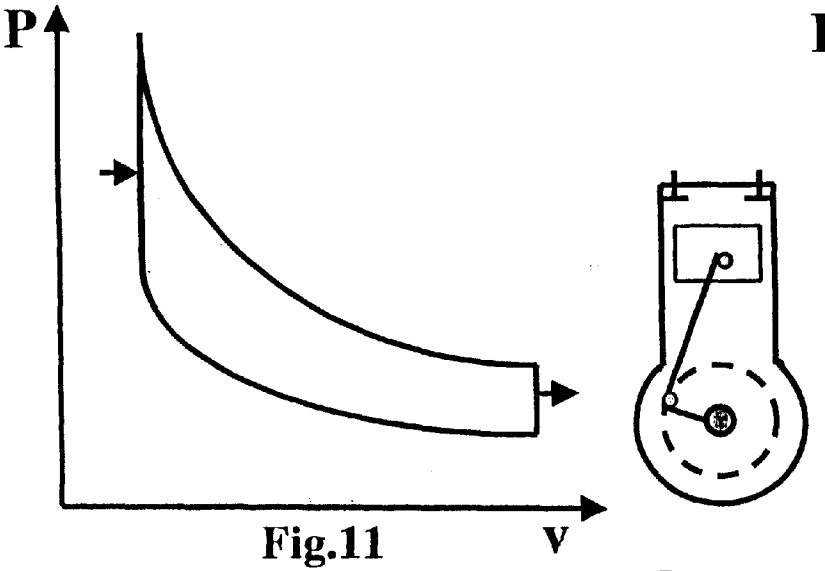
FIG. 11. The cycle curve of piston and Wankel engines.
Figure 12:
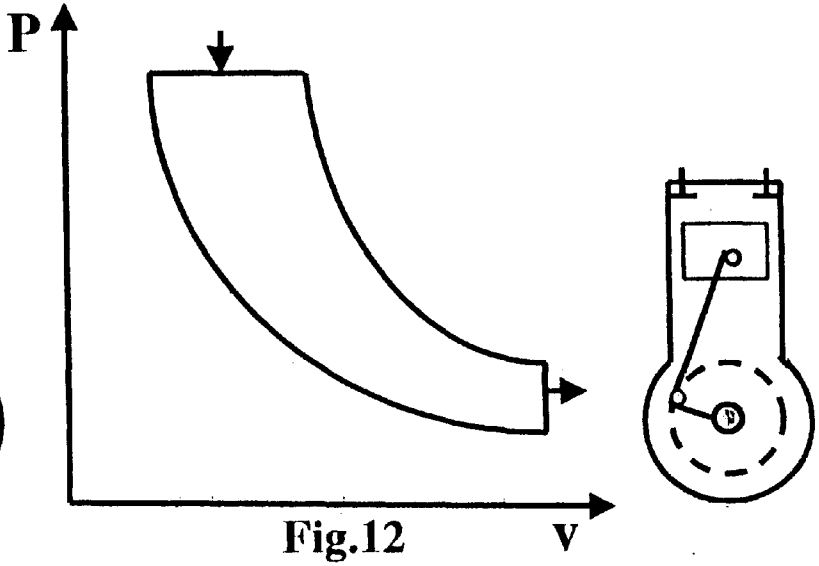
FIG. 12. The cycle curve of Diesel engine.

The modification 3 (FIG. 8) has two rotors separated by stationary partition 28 and connected by rotary blade rod (blade axle) 27. The end blades have splines 14, and the blade rod has flange 15. This flange stability of blade rod. The by-pass channel 13 passes the compressed air from section B to section C throw windows 10, 11. The rotor can have pits (grooves) 16, which allow to have a necessary cycle of gas cross—over and fuel combustion in small volume.

Figure 13:
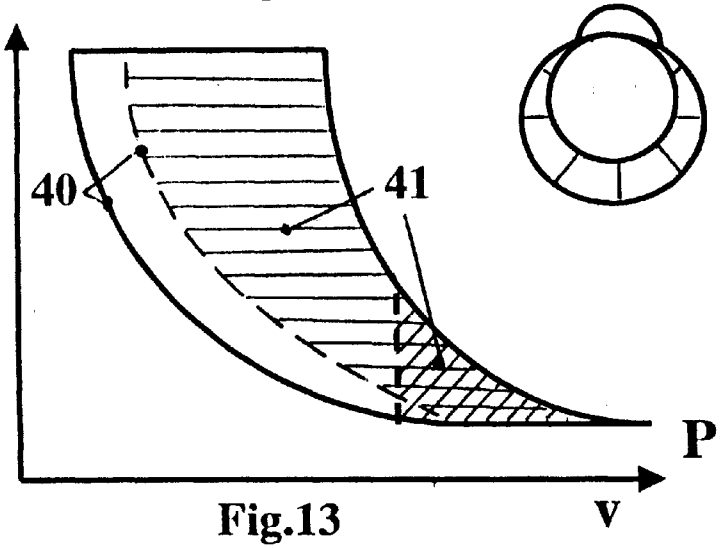
FIG. 13. The cycle curve of Eccentric engines, when one works with constant pressure, in comparison of Diesel and gas turbine engines. 40—curves of gas turbine engine, 41—additional work.
Figure 14:
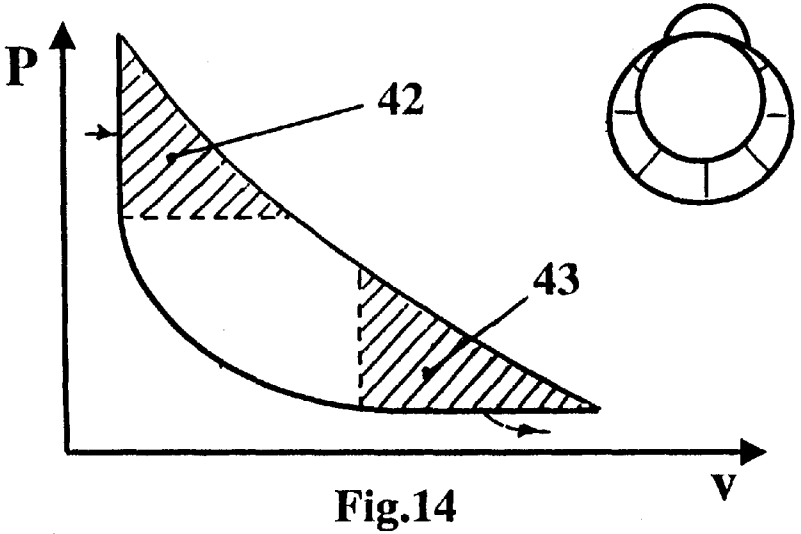
FIG. 14. The cycle curve of Eccentric engine, when engine works with constant volume, in comparison piston, Wankel, Diesel and gas turbine engines. 42, 43—additional work.

Since there is no power crankshaft and piston rod mechanism with huge variable loads, this rotary eccentric engine can develop revolutions of about 8—16 thousand per minute (depending on the diameter of the rotor) which is comparable to the revolution rates of gas turbines. This means that the engine begins to give power almost from zero, and its efficiency does not dependent on the revolutions. Instead, the efficiency suggested engines is significantly higher than gas turbine engine. Even though it operates on the same thermodynamic cycle, the increased efficiency is achieved because the eccentric engine doesn't have to compress the additional amount of air needed for lowering the temperature of the gases that wash the blades of a turbine (see FIG. 13). In addition, the efficiency of the rotor during compression is higher than the efficiency of the centrifugal and axle compressor of a gas turbine engine.

Figure 15:
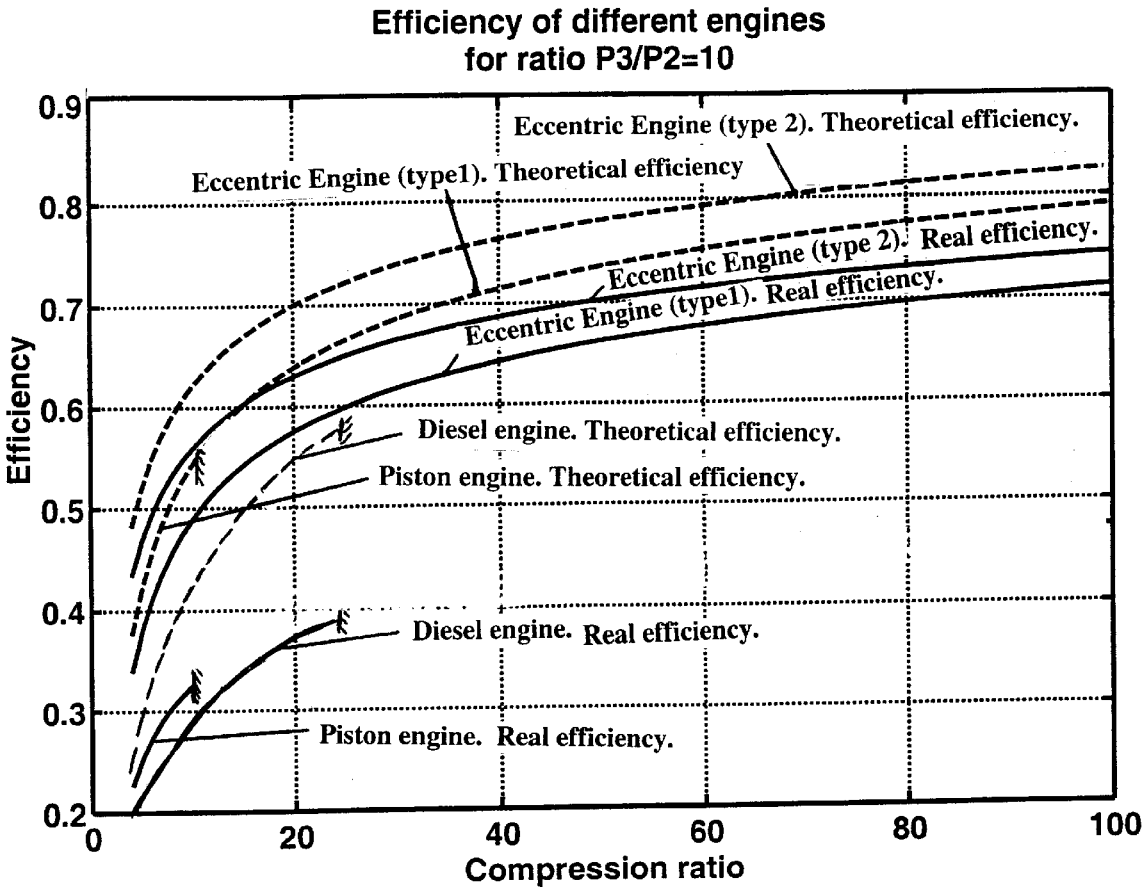
FIG. 15. Comparison efficiency of varies engines. A work of type 1 is work in constant pressure. A work of type 2 is work in constant volume.

The research has shown, that the eccentric engine has a very important advantage. A very high degree of compression (50–80) can be achieved which is unobtainable with piston carburetor engines (maximum 10–12) and diesels (maximum 25)(FIG. 15). In these latter engines, high degrees of compression are limited by the large loads on the crankshaft and connecting (piston) rod mechanism that the connecting rod must withstand. The suggested engine does not include the piston rod mechanism and decreases the fuel rate by 40–70% (FIG. 15).

The eccentric engine also increases the specific power, the revolutions per minute, while decreases the weight, and size. The mechanism is simpler and the production is cheaper than piston engines.

I claim:

1. An eccentric internal combustion engine comprising:

a hollow cylindrical stator having two sections: compression and expansion, said sections having different volumes;

at least one hollow cylindrical rotor locating in said stator, said rotor has slots and rotates in said stator;

a blade rod locating inside of said rotor and connecting to said stator;

four or more blades fastened at one end to said blade rod by rings with slug at a minimum of two symmetrical points about blade center, except for one of said blades is fastened at the central point, said blades reciprocating in said slots of said rotor;

a plurality of pieces seal locating in said slots of said rotor, providing a seal between said rotor and said blade, said pieces seals having slots;

a plurality of blade seals at an outer end of said blades, said blade seals having slots;

a by-pass channel locating in said stator, said by-pass channel connecting said compression section and expansion section by a direct and shortest way;

two combustion chambers which are used independently from each other, a first combustion chamber locating in said by-pass channel, a second combustion chamber locating between said rotor and said stator;

a plurality of grooves locating at an outer surface of said rotor, said grooves providing additional volume to said second combustion chamber;

at least one fuel injector located in each of said combustion chambers;

at least one partition separating said compression and expansion sections and locating within said stator; and a cooling system including components for said stator, internal part of said rotor, said blades, said blade rod, and said compression and expansion sections;

wherein said stator and said rotor having two sets of holes for cooling of internal parts of engine, a first set of holes locating near said second combustion chamber, a second set of holes locating near said blade rod at opposite side from said first set.

2. The eccentric engine as recited in claim 1 wherein said blades are fastened to said lugs by "herring bone" fashion.

3. The eccentric engine as recited in claim 1 further comprising:

a rotor partition rigidly disposed inside said rotor, wherein said blade rod is supported by said rotor partition;

a stator partition located inside said stator, said stator partition connecting to said stator, wherein said blade rod is supported by said stator partition; and two rotors, each of the rotors locating inside of said compression and expansion section, respectively, said rotors connecting by said rotate blade rod;

wherein said rings attaching to only one said blade in each of said compression and expansion sections, said rings having splines;

wherein said blade rod locating inside said stator and having sliding connection with said stator partition, and said blade rod rigidly connecting to said rotor and rotating with said rotor;

wherein said blade rod having splines, whereby one of said blades rigidly connecting to said blade rod in said compression and expansion sections;

wherein said blade rod having a flange locating in said stator partition to increase stability to said rotate blade rod; and wherein said by-pass channel locating at an upper surface of said stator, said by-pass channel including a fuel injector and a glow plug, said by-pass channel is used as said first combustion chamber, and said by-pass channel locating in said stator partition.

4. The eccentric engine as recited in claims 1 wherein said compression and expansion sections have the same volume.

5. The eccentric engine as recited in claim 1 comprising two drive shafts, each said drive shaft connecting to each said rotor.

* * * * *